United States Patent [19]

Trenary et al.

[11] 3,958,756

[45] May 25, 1976

[54] SPRAY NOZZLES

[75] Inventors: John Trenary, Fort Collins; David Smith, Wellington; Donald W. Ruehmann, Fort Collins; Christopher W. Elkins, Fort Collins; Elmer Erwin, Fort Collins; Roy Treadwell, Fort Collins, all of Colo.

[73] Assignee: Teledyne Water Pik, Fort Collins, Colo.

[22] Filed: June 23, 1975

[21] Appl. No.: 589,433

[52] U.S. Cl. ..... 239/102; 239/383; 239/444

[51] Int. Cl.[2] ..... B05B 1/08; B05B 1/30

[58] Field of Search ..... 239/101, 102, 380–383, 239/436, 443, 444–448, 449, 456, 455, 460, 451

[56] References Cited

UNITED STATES PATENTS

| | | | |
|---|---|---|---|
| 3,344,994 | 10/1967 | Fife | 239/460 X |
| 3,358,934 | 12/1967 | Moen | 239/448 X |
| 3,383,051 | 5/1968 | Fiorentino | 239/460 |
| 3,468,483 | 9/1969 | Parkison | 239/460 |
| 3,473,736 | 10/1969 | Heitzman | 239/383 X |
| 3,485,451 | 12/1969 | Gore et al. | 239/383 |
| 3,568,716 | 3/1971 | Heitzman | 239/383 X |
| 3,713,587 | 1/1973 | Carson | 239/383 |
| 3,762,648 | 10/1973 | Deines et al. | 239/102 X |
| 3,801,019 | 4/1974 | Trenary et al. | 239/102 X |
| 3,876,151 | 4/1975 | Katva | 239/443 X |

*Primary Examiner*—Robert S. Ward, Jr.
*Attorney, Agent, or Firm*—Hugh H. Drake

[57] ABSTRACT

A spray nozzle is of a kind including a housing that has a fluid inlet and first and second groups of spray discharge outlets. First and second flow paths are defined in the housing from the inlet to the first and second groups of outlets. Pulsation means in the first flow path cyclically interrupts the flow of fluid from the inlet to the first group of outlets so as to cause a pulsating spray to be discharged therefrom. The second flow path bypasses the pulsation means to cause a continuous non-pulsating spray to be discharged from the second group of outlets. Included are control means for adjustably dividing flow from the inlet between the first and second flow paths. New features include a special resilient seal that serves in part to define the second group of orifices, formation of the control means into a flow-directive plate cooperative with a shutter assembly together with a captivation arrangement for a seal effective between the two, specific stopping arrangements cooperative between the flow-directing plate and the shutter assembly, formation of a portion of the housing into a general tubular body that contains the pulsation means and in which portions of the flow paths are contained together with various arrangements of the same for obtaining adequate sealing between the different components, as well as additional retainer-type sealing arrangements coooperative within the overall structure.

21 Claims, 26 Drawing Figures

SPRAY NOZZLES

The present invention pertains generally to spray nozzles. More particularly, it relates to spray nozzles which may be adjusted to deliver either pulsating or continuous sprays and to improved sealing and related construction features appurtenant thereto.

U.S. Pat. No. 3,762,648, issued Oct. 2, 1973 and assigned to the same assignee as the present application, pertains to a spray nozzle having unique features capable of delivering a pulsating spray while overcoming or avoiding various undesired results such as water hammer in the supply pipelines. U.S. Pat. No. 3,801,019, issued Apr. 2, 1974 to the same assignee, is directed to a number of improvements on the subject matter of the first-mentioned patent. These improvements include, but are not limited to, an arrangement which permits also being able selectively to obtain from the same unit a non-pulsating spray, a pulsating spray or an adjustable combination of both pulsating and nonpulsating sprays.

The subject matter of the aforementioned Letters Patent has been successfully incorporated into products which have been well received by a number of users. Employed as a showerhead, the pulsating spray produces a massaging effect which, on striking the body of a person using the showerhead, in many instances is found to be stimulating. Yet, a more normal-type spray also is available when desired.

Because of the aforementioned and other features of the products, the latter have received quite satisfactory acceptance by the user. Nevertheless, certain problems have occurred in use and others have been encountered in continued production. Considerable ingenuity has been required in the resolution of those problems.

In accordance with the foregoing, it is, therefore, a general object of the present invention to provide an improved spray nozzle that overcomes and/or resolves such problems as have appeared in the prior products.

A specific object of the present invention is to provide an improved showerhead which includes more efficacious sealing arrangements among various different parts while enabling satisfactory efficiency of production.

A related object of the present invention is to provide improvements in such a spray nozzle which increase durability while not at least excessively increasing manufacturing costs.

A spray nozzle of the kind to which the invention is directed includes a housing that has a fluid inlet together with a first and a second group of fluid spray discharge outlets. Defined in the housing is a first flow path from the inlet to a first group of outlets and a second flow path from the inlet to a second group of outlets. Pulsation means included in the first flow path cyclically interrupts the flow of fluid from the inlet to the associated first group of outlets so as to cause a pulsating spray to be discharged therefrom. The second flow path bypasses the pulsation means to cause a continuous non-pulsating spray to be discharged from the second group of outlets. Control means is associated for adjustably dividing the flow from the inlet between the first and second flow paths.

One specific feature is the inclusion of a spray cup assembly that has a tubular main body across one end of which extends an end wall with that main body having an external diameter less than the internal diameter of the end of the housing opposite the fluid inlet so that the spray cup assembly is received within that end of the housing. The first group of outlets are defined in that end wall. Extending around the lateral exterior of the spray cup assembly is an annular groove of predetermined width in the direction axially of the spray cup assembly. A series of slots are defined in the internal wall of the housing at that end thereof with those slots extending in the axial direction and being distributed around the internal wall circumference. A seal of resilient material formed in the shape of a washer has an integral cross-section in the axial direction that is composed of a pair of legs spaced apart by a connecting web. The length of one of those legs is at least approximately the same as the width of the groove. The seal is seated between the slots and the groove with that one leg being disposed in the groove and the other leg extending across the open radially-inner sides of the slots so as, together with the slots, to define the second group of outlets.

In accordance with a further specific implementation, a flow-directing plate is mounted in the housing between the inlet and the outlets and has first and second openings therethrough respectively establishing communication between the inlet and the first and second flow paths. Those first and second openings are located near the periphery of the plate and spaced apart around that periphery. The nozzle further includes a shutter means slidably mounted on the plate for coordinated movement into and out of overlying flow-blocking relationship with the openings between a first position wherein the second opening is blocked and flow from the inlet is directed through the first opening and a second position wherein the first opening is blocked and flow from the inlet passes through the second opening. Movement of the shutter means between such positions progressively changes the amount of flow respectively delivered through each of the openings. As a feature associated with that implementation, a counterbore is included in one of the openings from the inlet side of the plate, and a resilient annular seal element is seated in that counterbore. Cooperating therewith, the shutter means includes an annular ring from which project radially inward a plurality of shutter blades respectively spaced individually around the periphery of the ring. Movement of the shutter means between the positions alternately covers and uncovers respective ones of the openings with corresponding ones of the blades. Moreover, the one of the blades which covers the one of the openings serves to captivate the resilient annular seal in sealing relationship with its counterbore.

As another feature of such implementation, there are a plurality of each of the first and second openings alternatively and symmetrically placed around the periphery of the plate together with a correspondingly increased plurality of the shutter blades spaced around the periphery of the ring. Moreover, there also are a plurality of stop ribs each of which projects from the plate substantially through the shutter means toward the inlet and individually spaced radially inward from alternate ones of the blades in the path of corresponding intervening ones of those blades.

In accordance with yet another feature of the implementation under discussion, a generally tubular body constitutes a portion of the housing and contains the pulsation means. Defined in that body are first and second flow passages that extend axially therethrough and respectively constitute respective portions of individually different ones of the flow paths. These flow passages are adjacent to and spaced successively around the periphery of the body in communication with the respective ones of the first and second openings in the plate. An end wall of the body is defined through which the second flow path extends. Included in the housing are means defining a mating wall through which the second flow path also extends. An annular washer is sandwiched between the end wall and the main wall with that washer having means defining apertures through which the first and second flow paths respectively extend. Finally, a rib projects outwardly from one of the walls into sealing engagement with the washer. The rib extends continuously around the general perimeter of the one wall and is disposed radially outward of one of the flow paths and radially inward of the other.

As a still further feature of this implementation, the housing includes an end cup portion that includes a fluid inlet. Projecting through that end cap is means for enabling the movement of the shutter means. An ear projects from the flow directing plate into engagement with the end cap portion for sealing the plate in position within the housing. Disposed around the perimeter of the end cap is a washer that seals with the perimeter of the shutter means. An annular retainer member is disposed against the end cap and immediately within the washer radially, that retainer member including means defining an opening which accommodates the projecting means and another opening through which the end of the ear projects into contact with the end cap.

The features of the present invention which are believed to be novel are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 2:
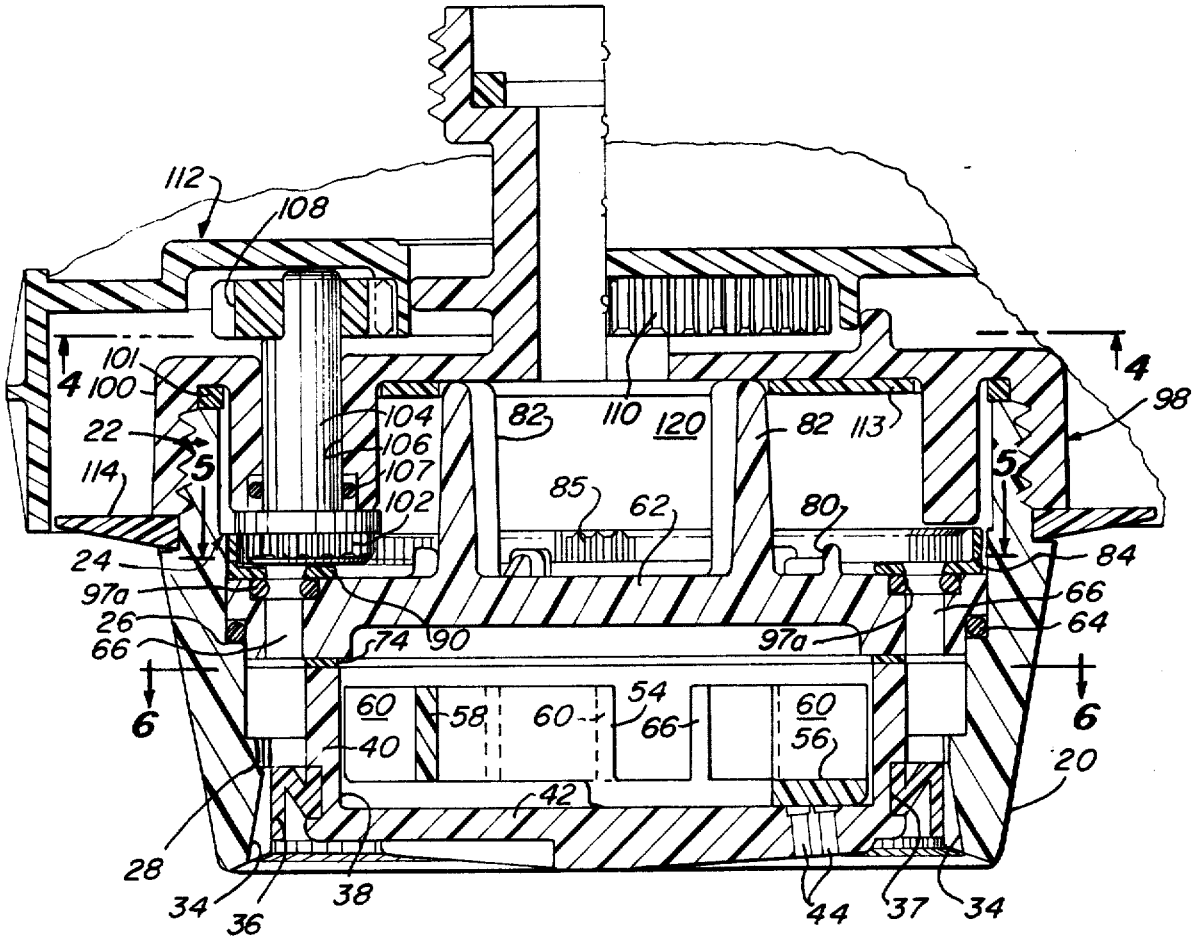
FIG. 2 is a cross-sectional view taken along the line 2—2 in FIG. 1.
Figure 5A:
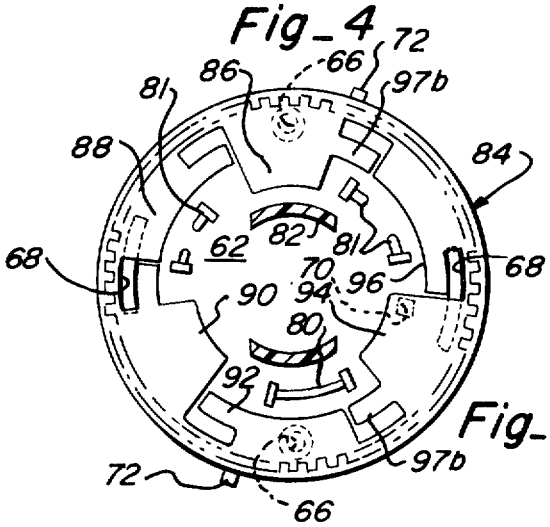
Figure 5B:
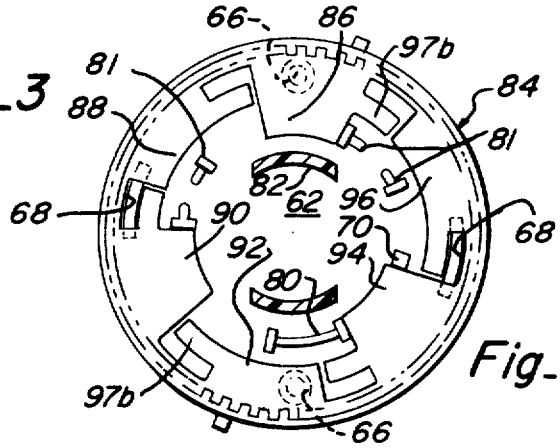
Figure 5C:
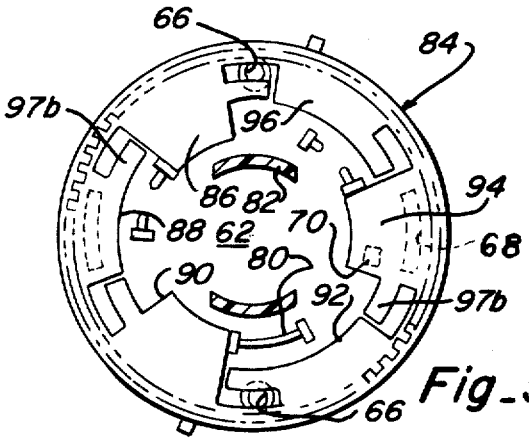

FIG. 5*a* is a schematic view taken along the line 5—5 in FIG. 2 and depicting shutter valve operation at one position in its range of movement;

FIG. 5*b* is a view similar to FIG. 5*a* but showing the shutter valve operation at one end limit of movement;

FIG. 5*c* is a view similar to those of FIGS. 5*a* and 5*b* but showing the shutter valve at an opposite end limit of movement from that shown in FIG. 5*b;*

Figure 3:
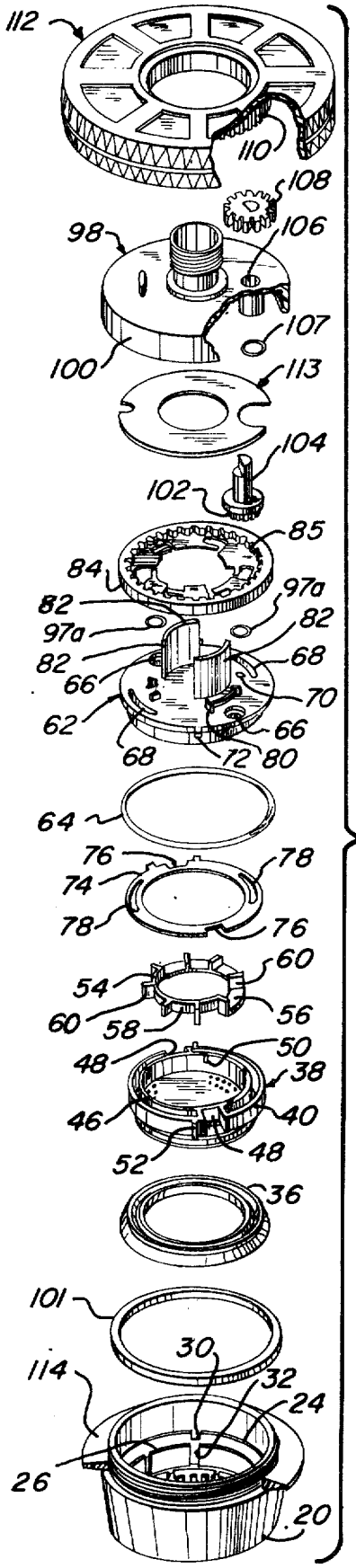
FIG. 3 is an exploded perspective view of most of the parts of the spray nozzle shown in FIGS. 1 and 2.
Figure 4:
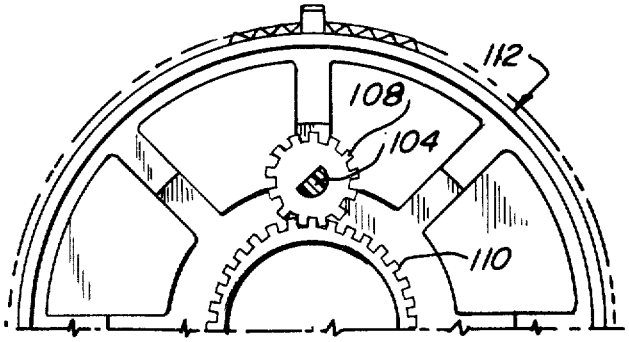
FIG. 4 is a fragmentary but detailed plan view, partially in section, showing a portion of a shutter-valve operating mechanism incorporated into the apparatus of the preceding figures.
Figure 6:
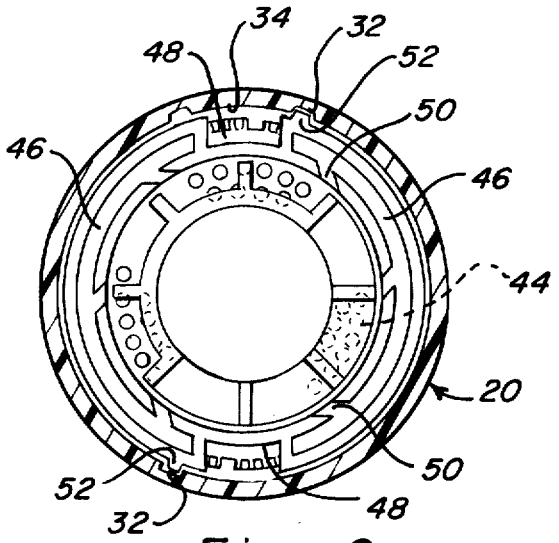
Figure 7D:
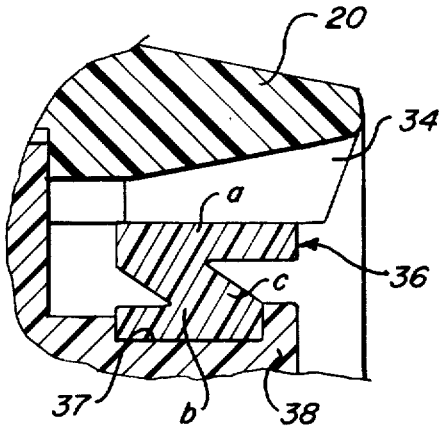
Figure 7A:
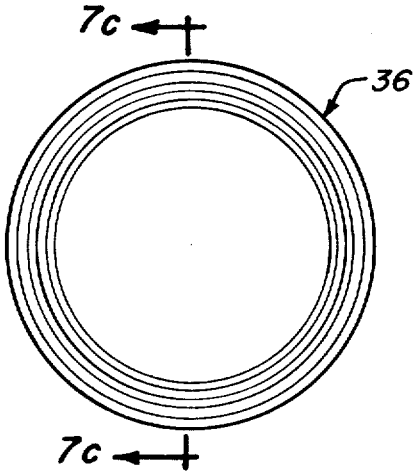

FIG. 6 is a detailed cross-sectional view taken along the line 6—6 in FIG. 2;

FIG. 7*a* is a front-elevational view of a sealing element shown in FIGS. 2 and 3.

Figure 7B:
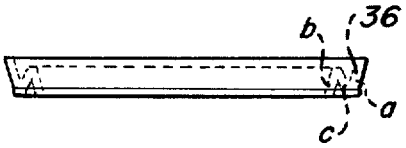

FIG. 7*b* is a side-elevational view of the sealing element shown in FIG. 7*a;*

Figure 7C:
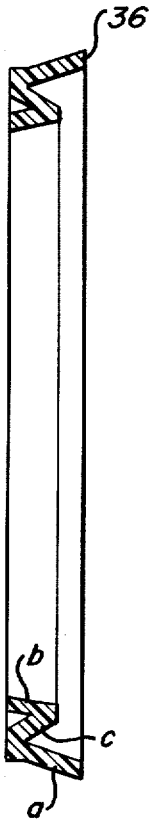

FIG. 7*c* is an enlarged cross-sectional view taken along the line 7*c*—7*c* in FIG. 7*a;*

Figure 8:
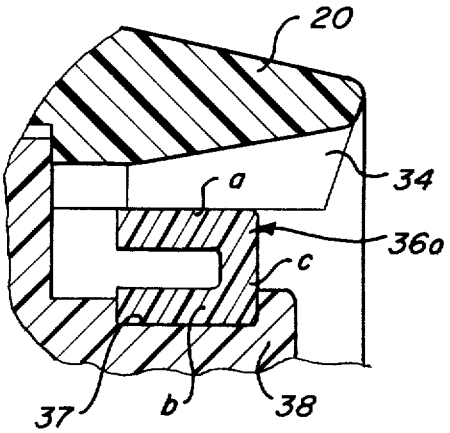
Figure 9:
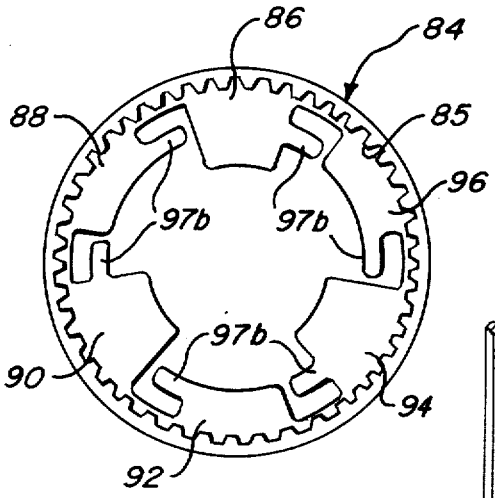

FIG. 7*d* is a fragmentary and incomplete cross-sectional view showing the sealing element of FIGS. 7*a*–7*c* as installed in the spray nozzle as revealed in FIGS, 2 and 3;

FIG. 8 is a fragmentary cross-sectional view similar to that of FIG. 7*d* but showing an alternative form of the sealing element;

FIG. 9 is a plan view of a shutter plate depicted particularly in FIGS. 2 and 3 and the operation of which is explained in connection with FIGS. 5*a*–5*c;*

Figure 10A:
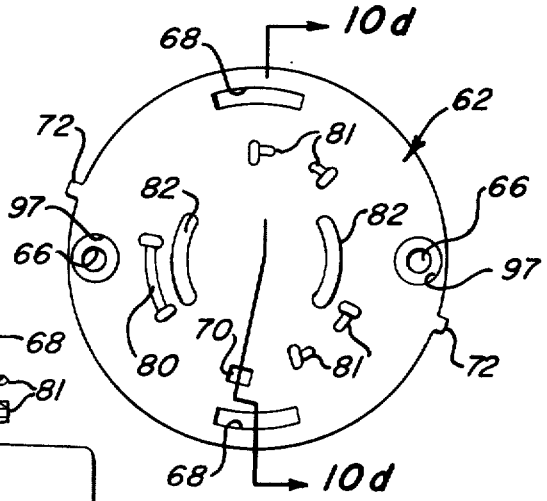
Figure 10D:
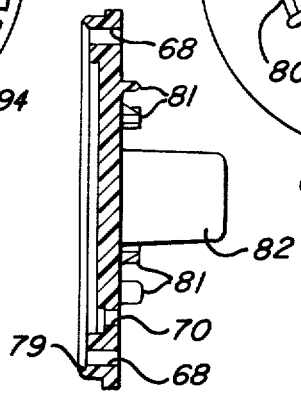
Figure 10B:
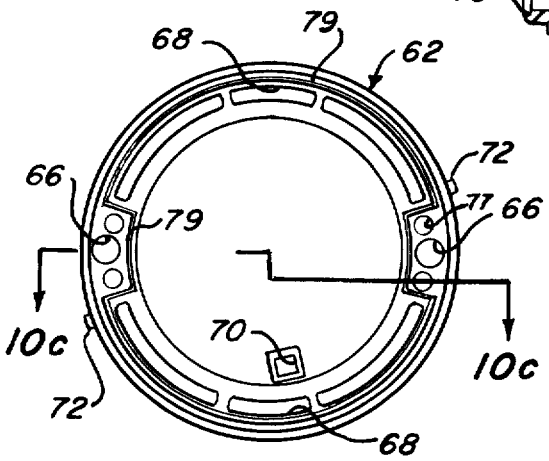

FIG. 10*a* is a plan view of a flow-directing plate shown in FIGS. 2 and 3;

FIG. 10*b* is a bottom view of the plate shown in FIG. 10*a;*

Figure 10C:
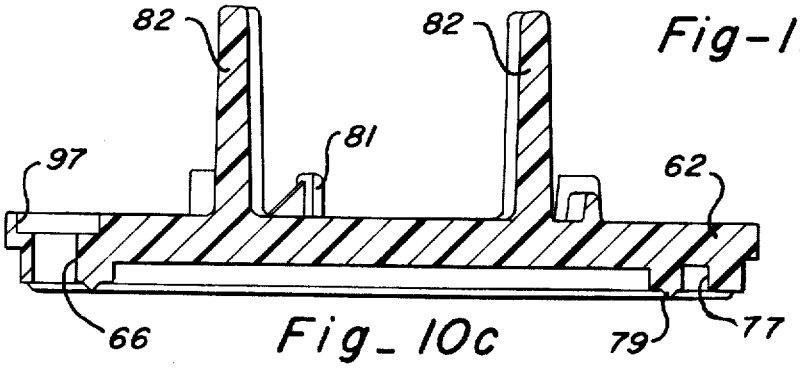

FIG. 10*c* is a cross-sectional view taken along the line 10*c*—10*c* in FIG. 10*b;*

FIG. 10*d* is a cross-sectional view taken along the line 10*d*—10*d* in FIG. 10*a;*

Figure 11A:
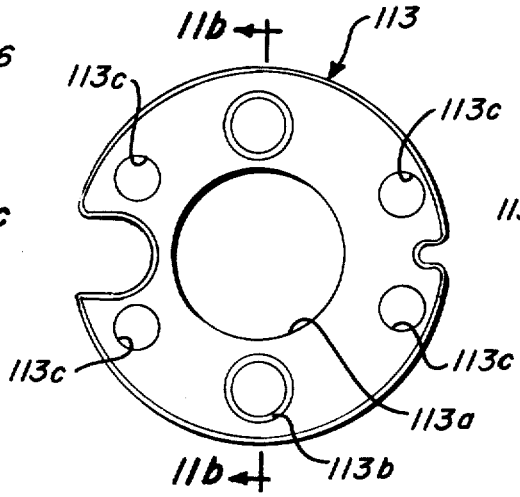
Figure 11:
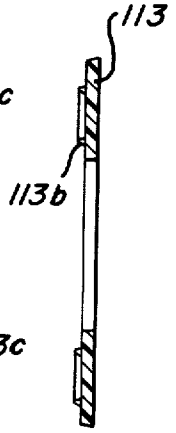

FIG. 11*a* is a plan view of a retainer member shown in FIGS. 2 and 3;

FIG. 11*b* is a cross-sectional view taken along the line 11*b*—11*b* in FIG. 11*a;*

Figure 11C:
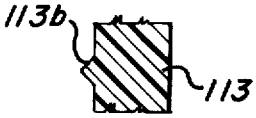

FIG. 11*c* is an enlarged fragmentary cross-sectional view of a portion of the member shown in FIGS. 11*a* and 11*b;*

Figure 12:
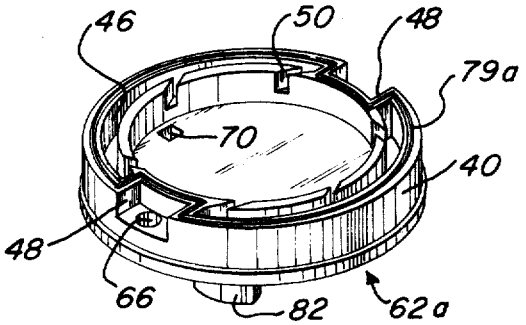
Figure 15:
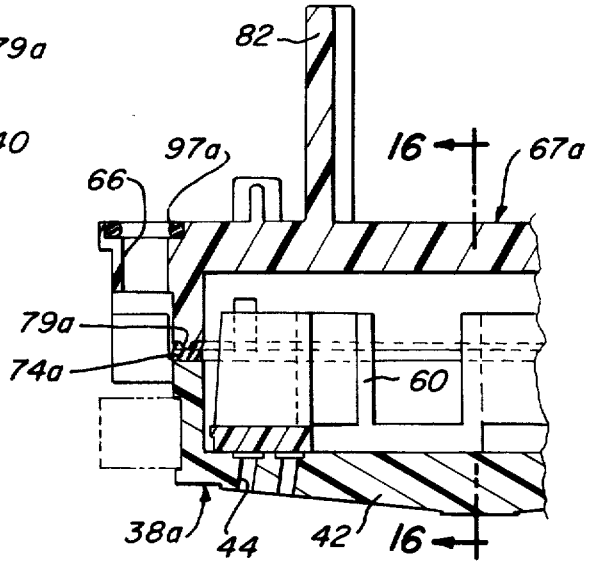
Figure 13:
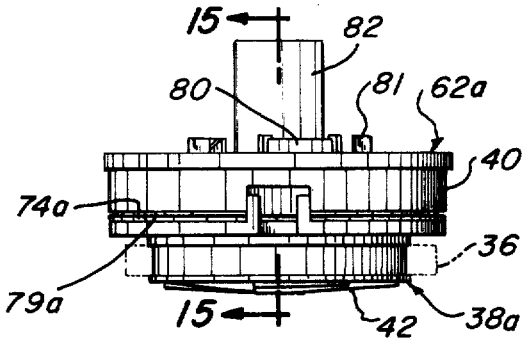
Figure 16:
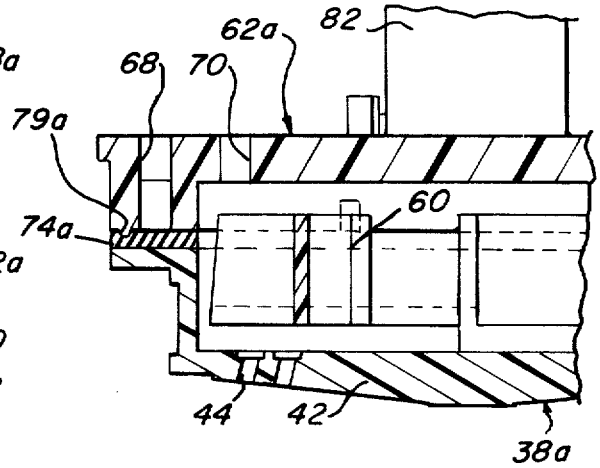
Figure 14:
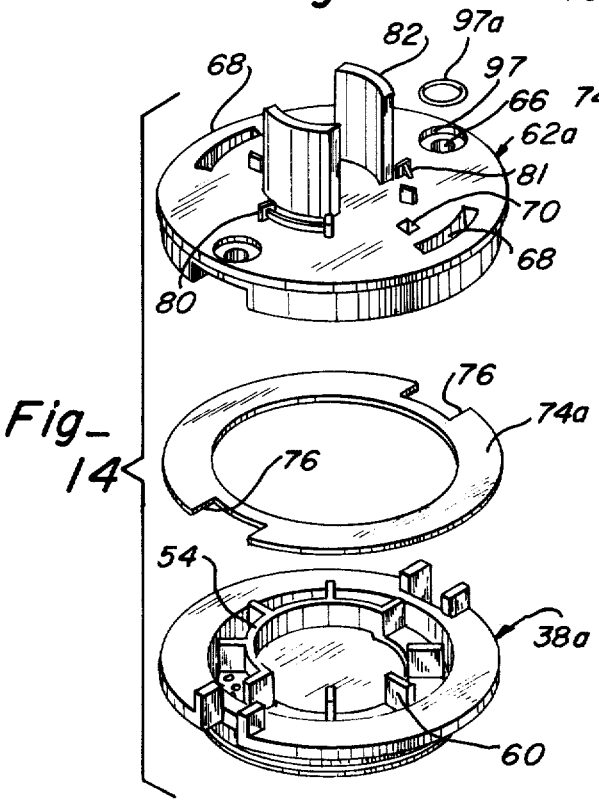

FIG. 12 is a perspective view of an alternative form of a portion of the apparatus shown particularly in FIGS. 2 and 3;

FIG. 13 is a side elevational view of the portion shown in FIG. 12 mated with a cooperating portion of the overall assembly;

FIG. 14 is an exploded perspective view of the apparatus shown in FIG. 13;

FIG. 15 is a fragmentary cross-sectional view taken along the line 15—15 in FIG. 13; and FIG. 16 is a fragmentary cross-sectional view taken along the line 16—16 in FIG. 15.

Figure 1:
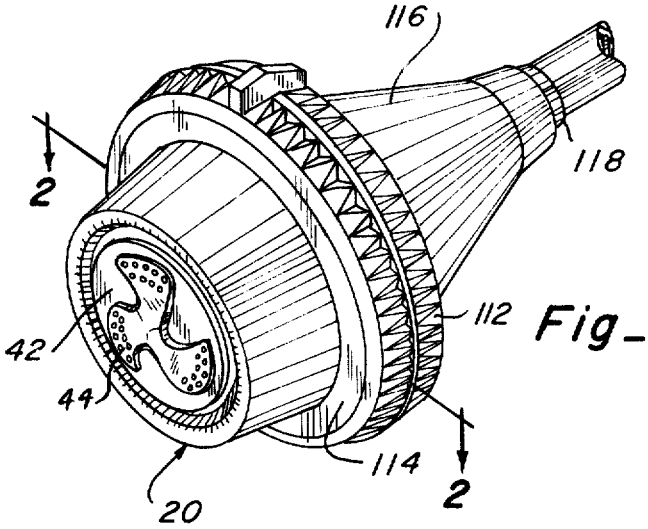
FIG. 1 is a perspective view of one form of spray nozzle in which the features of the present invention are incorporated.

FIG. 1 depicts a showerhead constructed for connection to and mounting upon a stationary supply pipe as conventionally emerging through the wall near the top of a showerstall. By comparison with the aforesaid U.S. Pat. No. 3,801,019, it will be observed that essentially the same structure may be arranged for attachment to the end of a flexible pipe so as to be capable of being held in the hand of the user. Either form of usage and adaptation is contemplated for the embodiments specifically described herein.

As illustrated, the showerhead includes a lower housing unit 20 of hollow tubular configuration formed with an externally threaded neck 22 at its upper end. The internal central passage through lower housing 20 is formed with three radial shoulders 24, 26 and 28 which provide seats for axially locating other elements of the showerhead within lower housing 20. Two sets of diametrically opposed axial grooves 30 and 32 extend downwardly respectively from shoulders 24 and 26 to orient rotatively other elements of the assembly. The lower end of the central passage through housing unit 20 is formed with a series of axially extending slots 34. As assembled, a washer 36 is seated to extend across the open radially inner sides of grooves or slots 34 in order to complete definition of slots 34 as one group of spray discharge outlets. At its radially-inward side, washer 36 is seated within an annular groove 37 formed on the exterior of a spray cup assembly 38 that has a tubular main body 40 and an end wall or orifice plate 42 seated within and extending across the open bore end of tubular body 40.

Washer 36 is a seal of resilient material. As shown in detail in FIGS. *7a–7d*, washer 36 has an integral N-shaped cross section, in the axial direction of the unit, composed of a pair of legs *a* and *b* spaced apart by a connecting web *c*. Leg *b* is of a length at least approximately the same as the width, in the unit's axial direction, of groove 37. When the unit is assembled, washer or seal 36 is seated between slot 34 and groove 37 with leg b disposed in groove 37 and leg a extending across the open radially inner sides of slots 34 so as, together with slots 34, to define a group of orifices or outlets distributed around the lower end of housing 20. Preferably, the outer sides of those orifices are inclined with respect to the longitudinal axis of the unit so as successively to define alternate angles of 2° and 5°, a typical embodiment being formed to include thirty orifices of each of the two different exterior side angles.

Particularizing further, leg a of washer 36 has a length sufficient to extend over at least substantially the entire axial length of slots 34. This serves to insure that the individual jets emerging from each of the different ones of slots 34 coordinate to provide a pair of stable concentric spray patterns corresponding to the two different slot angles. Absent the substantially total interior definition of slots 34 by leg *a*, erratic spray distribution has been found to exist in some implementations. As specifically shown, web *c* extends from the end of leg *b* adjacent to the outlet end of the assembly to the end of leg *a* adjacent to the inlet end of slots 34. When washer 36 is unseated from its in-use position between groove 37 and slots 34, leg a flares radially outwardly with increasing distance away from the junction between web *c* and leg *b*, as shown in FIG. *7c*. When seated, water pressure exerted against the inwardly facing notch formed between web *c* and leg *b* serves to augment the sealing function of washer 36.

In an alternative embodiment as shown in FIG. 8, a washer 36*a* is of U-shaped cross section. That is, web *c* constitutes the bite portion of the U. In particular, web c faces toward the outlet end of the slots. Thus, the open end of the U faces the incoming flow of water so as, once again, to have its sealing function augmented by the pressure provided thereby.

Bored through end wall 42 are three like groups of discharge orifices 44 that lie in a symmetrical relationship within an annular band concentric with the central axis of the unit. At the upper end of main body 40, a pair of like flow-carrying troughs 46 extend partially around the outer circumference of member 40 in symmetrically-disposed relationship. The adjacent ends of troughs 46 terminate short of each other so as to provide a pair of axially extending flow passages 48 through the troughs, passages 48 being diametrically opposed to each other. A plurality of tangentially-directed passages 50 pass through the radially inner wall of each of troughs 46, so that water flowing through the troughs is discharged tangentially into the central passage of main body 40. The exteriors of troughs 46 are seated upon the lowermost shoulder 28 of lower housing 20 so as axially to locate spray cup 38 within housing 20, the cup being rotatively oriented within housing 29 by a pair of projecting lugs 52 received within locating slots 32 of housing 20. When spray cup 38 is seated within housing 20, washer 36 is radially compressed so that, as already described, its leg a is disposed over slots 34 so as to define one group of orifices, while orifices 44 in end wall 42 define a second group of spray discharge orifices.

A rotary valve member 54 rests upon the inner or upper side of end wall 42 and is retained by the inner wall of main body 40 for rotation about the central axis of the unit. Valve member 54 is a one-piece molded element preferably formed from a glass-reinforced nylon material. The valve member includes a flat, generally *c*-shaped baseplate portion 56 which lies in a radial general plane and extends for approximately 180° about its central axis. A semicylindrical portion 58 is integrally joined to the opposite ends of portion 56 and extends angularly around the remaining 180° of member 54. The lower edge of semicyclindrical portion 58 is coplaner with the top or upper flat surface of portion 56, so that the latter has its lower surface spaced downwardly form the lower edge of portion 58. A plurality of radially extending blades 60 are integrally mounted upon portions 56 and 58 in symmetrically spaced relationship to the central axis of the unit. The relative angular extent of portion 56 may vary. However, the 180° extent shown in the drawings represents a preferred form.

Portion 56 of valve rotor 54 rests upon the inner surface of end wall 42 of the spray cup assembly and is so located as to cover, at all times and rotative positions, at least a portion of orifices 44, the annular band within which orifices 44 lie corresponding in general to the annular path traversed by portion 56 upon rotation of valve rotor 54. Radial blades 60 are so located as to be struck by water discharged through tangential passages 50, and valve rotor 54 is thus driven in rotation at a rate which varies with the rate of flow of water through tangential passages 50 of the spray cup assembly.

A flow-directing plate 62 overlies the upper end of spray cup 38 and is employed to direct and control the flow of water to the various discharge orifices. An O-ring 64, seated between the periphery of plate 62 and housing 20, provides a seal against the flow of water around the outer periphery of plate 62. Plate 62 is formed with a first pair of circular openings 66 which are located in diametrically-opposed relationship to each other and a second pair of diametrically-opposed segmentally-shaped openings 68. Also included is a third segmental opening 70. Radially-projecting tabs 72 on plate 62 are engaged in slots 30 in housing 20 to rotatively orient plate 62 relative to spray cup 38, so that openings 66 are vertically aligned with and communicate directly with flow passages 48 in spray cup 38. At the same time, openings 68 in plate 62 are aligned and communicate with troughs 46 of spray cup 38, while opening 70 is located radially inwardly of the inner wall of main body 40 of spray cup 38. A gasket 74 is seated between the lower side of flow-directing plate 62 and the upper end of spray cup 38. That is, plate 62 is seated upon gasket 74. Shoulder 26 provides a stop for O-ring 64 when water pressure is applied. Gasket 74 is formed with notches 76 and openings 78 respectively aligned with openings 66 and 68 in plate 62.

Referring to FIGS. 10*a*–10*b*, and particularly to FIG. 10*b*, it will be observed that the underside of plate 62 is formed to define respective portions of passages 66, 68 and 70 so as to cooperate with the coordinating passage portions defined in spray cup 38 as well as with notches 76 and openings 78 in gasket 74. That is, the generally tubular body portion of the housing which contains valve member 54 and tangential passages 50 is characterized by mating walls through which the different flow paths or passages wholly or partially extend. On the wall defined by the bottom side of plate 62 is an outwardly projecting rib 79 that is pressed into sealing engagement with gasket 74. Rib 79 extends continuously around the general perimeter of the underside of plate 62 and is disposed radially outward of the flow paths defined by openings 68 and radially inward of the flow paths defined by openings 66. Rib 79 serves as a seal director that prevents gasket 74 from extruding under pressure and insures a better seal between plate 62 and spray cup 38. As a result, the facing surfaces of plate 62 and spray cup 38 need not be as accurately formed in parallel relationship. Small recesses 77 are formed on the underside of plate 62 on either side of openings 66.

FIGS. 12–16 depict an alternative arrangement of the elements as distributed between a flow-directing plate 62*a* and a spray cup 38*a*. In this case, the annular walls which define passages 50 are integral with plate 62*a*, downwardly extending therefrom. Only passages 66 extend on through the sidewalls of spray cup assembly 38*a*. Again, there are facing walls between which is sandwiched a washer 74*a*. For this arrangement, of course, washer 74*a* need only be notched to accommodate the flow passages that extend from openings 66. The facing and mating walls feature, in this case on the underside of the lower extremity of plate 62*a*, a rib 79*a* that completely circumscribes the periphery and is between the two different sets of flow passages. Alternatively, the flow-directing rib may be placed on the opposite element, so long as it still serves to divide the maximized sealing pressure in a position between the two different sets of flow passages.

Integrally formed on the upper surface of plate 62 (or 62*a*) are a segmentally-shaped upward-projecting stop rib 80, spaced stop-ribs pairs 81 and a pair of upwardly projecting compression tabs 82. Slidably supported for rotation upon the upper surface of plate 62 is an annular shutter plate 84 which takes the form of an internal ring gear 85 having six symmetrically-disposed segmentally-shaped shutter blades 86, 88, 90, 92, 94 and 96 projecting radially inwardly from the lower side of ring gear 85. As perhaps best seen in FIGS. 5*a*–5*c*, the radially-inward extent of shutter blades 86, 90 and 94 exceeds that of blades 88, 92 and 96, so that alternate blades are of relatively short or relatively long inward-radial extension. The internal radial extension of blades 88, 92 and 96 is such that the inner ends of those blades fall radially outward beyond the circle defined by stop ribs 80 and 81, while blades 86, 90 and 94 project radially across that circle or location. Thus, when shutter plate 84 rests on top of flow directing plate 62, rotary movement of the shutter plate is limited to one end limit defined by the engagement of one of blades 86, 90 and 94 with a corresponding one end of stop ribs 80 and 81 and an opposite end limit defined by the engagement of an adjacent blade 86, 90 and 94 with a corresponding opposite end of those ribs. It will be observed that the different sets of stop ribs, whether continuous or discontinuous, each project from plate 62 very substantially through shutter plate 84 in the direction of the inlet end of the unit. Moreover, the stop ribs are individually spaced radially inward from the alternate ones of the blades so as to be in the path of corresponding intervening ones of the blades.

Directing attention again to each of passages 66 in plate 62, a counterbore 97 extends a short distance into each of passages 66 from the inlet side of plate 62. Seated within each of counterbores 97 is an O-ring 97*a* which serves as a resilient annular seal element. Considering the peripheral portions of plate 84 that join the different ones of the shutter blades as being divided portions of the base of the blades themselves, it will be observed that at least one blade always serves at least partially to captivate the corresponding one of O-rings 97*a*. To extend the degree of such captivation of the corresponding O-rings 97*a*, web members 97*b*, spaced inwardly from the periphery of plate 84, project at least substantially across the respective spaces between successive ones of the shutter blades. Web members 97*b* are in a position that maintains captivation of O-rings 97*a* even when shutter plate 84 is so moved as to remove the corresponding ones of the blades from a covering relationship to openings 66. To that end, each of web members 97*b* projects integrally from one side of one of the shutter blades and extends into close-spaced relationship with the successive one of the blades.

The individual parts described thus far are held in their assembled position by a connecting tube member 98 that has an annular skirt 100 which is internally threaded so as to receive the external threads on the upper end of lower housing unit 20. Tube member 98 is sealed to unit 20 by a washer 101. Rotation of shutter plate 84 is accomplished by a pinion gear 102 meshed with ring gear 85 and having its shaft 104 rotatively received within a bore 106 in connecting tube 98. An O-ring 107 seals shaft 104 to bore 106. A second gear 108, rotatably locked to shaft 104 at the exterior of connecting tube 98, is meshed with a gear 110 integrally formed on a control ring assembly 112 rotatively supported upon connecting tube 98.

It will thus be seen that connecting tube member 98 serves as an upper end cap for the operative portion of the housing. Disposed between end cap 98 and shutter plate 84 is an annular retainer member 113. Member 113 is affixed against the inner or lower side of the end cap and has a diameter so as to lie immediately within washer 101. As shown, member 113 is a separate part. Preferably, however, member 113 is molded integrally as a part of connecting tube member 98. In either case, retainer member 113 prohibits radial distortion of washer 101. Retainer member 113 includes offset openings that accommodate the boss in which bore 106 is formed, an opposite balance stub and a central opening 113*a* which permits compression tabs 82 to project into contact with end cap or connecting tube member 98. Moreover, retainer member 113 in the form illustrated includes a plurality of embossed or die-formed outwardly-projecting ribs 113*b* and sonic-welding rings 113*c* that engage the under surface of connecting tube member 98 so as to insure secure seating in plate of retainer member 113.

When connecting tube member 98 is threadably mounted on lower housing unit 20, compression tabs 82 of flow directing plate 62 are engageable with the underside of connecting tube member 98 so that, as the latter and lower housing unit 20 are threaded into each other, flow directing plate 62 is forced downwardly against the top of spray cup 38 to clamp gasket 74 and also to force spray cup 38 downwardly so that its troughs 46 are seated on lower shoulder 28 in housing 20. It is not necessary that flow directing plate 62 be firmly seated axially against shoulder 26, since O-ring 64 is radially compressed to form the necessary seal around the outer periphery of plate 62. During assembly, an annular ring 114 is trapped between the lower end of connecting tube member 98 and a shoulder on lower housing unit 20. Ring 114 is primarily for cosmetic purposes and provides a stationary member upon which a scale, for indicating the rotative position of control ring 112 relative to the housing, may be located. An upper housing unit 116 is threadably received upon the upper end of connecting tube 98. When threaded onto tube 98, unit 116 frictionally clamps a swivel ball fitting 118 to the unit so as to provide a means for mounting the assembly upon a stationary supply pipe. The skirt of upper housing unit 116 also serves to confine control ring 112. Desirably, a filter screen is held by a washer in the inlet of connecting tube 98.

As in the aforementioned U.S. Pat. No. 3,801,019, the overall showerhead herein described is operable to deliver three general types of sprays — an all-continuous spray in which all water discharged from the showerhead is delivered in continuous uninterrupted streams, an all-pulsating spray in which all water delivered from the showerhead is discharged in pulsating or cyclically interrupted streams, or a combination of continuous-pulsating spray in which a portion of the water is discharged in continuous streams while the remaining portion is discharged as a pulsating cyclically interrupted spray. The showerhead, when discharging a combination spray, may be adjusted to vary selectively the proportioning of relative amounts of continuous spray to pulsating spray. This adjustment is made in a manner such that the frequency of pulsation of the pulsating spray component is increased as the proportion of the pulsating spray to continuous spray is changed. When the device is operated to produce an all-pulsating spray, the frequency of pulsation, of the spray may be selectively varied. In use, water from the stationary supply pipe enters the showerhead through ball fitting 118 and passes into an inlet chamber 120 enclosed by connecting tube 98, lower housing unit 20 and flow directing plate 62. Neglecting for the moment shutter plate 84, it will be seen that inlet chamber 120 is provided with two sets of outlets constituted of openings 66, 68 and another opening 70 through flow directing plate 62. Openings 66, 68 and 70 respectively constitute the inlet ends of three separate and distinct flow passages through the showerhead.

A first flow passage from inlet chamber 120 extends from opening 68 to the interior of trough 46 of end cup 38 and thence through tangential passages 50 into the interior of spray cup 38 so as to communicate with discharge orifices 44. Water following this first flow passage impinges on blades 60 of rotary valve member 54 as the water is discharged from tangential passages 50. Thus, the water following this flow passage drives valve rotor 54 in rotation so as cyclically to interrupt the streams of water discharged from orifices 44 as flat plate portion 56 of rotary valve 54 rotates through overlying relationship with the individual ones of orifices 44.

A second flow passage extends from inlet chamber 120 through opening 70 in plate 62 and passes from opening 70 directly into the interior of spray cup 38 for discharge through orifices 44. Because water flowing through this second flow passage is discharged axially to the interior of spray cup 38, water following the second flow passage does not contribute to the rotary speed of valve rotor 54 and, in fact, exerts a slight braking action on the rotor as the rotating blades strike the axially directed stream from opening 70. The water following the first and second passages is divided at plate 62 and recombined within the interior of spray cup 38 prior to discharge orifices 44. Consequently, all water flowing through those first and second flow passages is discharged from orifices 44 as a pulsating spray.

A third flow passage extends from inlet chamber 120 through openings 66 in plate 62. Openings 66 are aligned with passages 48 on the exterior of spray cup 38, passages 48 communicating directly with the second group of orifices 34. Because the third flow passage is at the exterior of spray cup 38, water flowing through the third flow passage bypasses valve rotor 54 and is discharged in a continuous stream from orifices 34.

Control of the frequency of pulsation of the spray and the apportioning of the relative amounts of pulsating to non-pulsating spray is accomplished by rotatively positioning shutter plate 84 so as fully or partially to block openings 66, 68 and 70 is accordance with the position of the various shutter blades relative to the openings. Referring again to FIGS. 5*a*–5*c*, shutter plate 84 is shown at three basic positions of rotative adjustment relative to flow directing plate 62. In FIG. 5*a*, shutter plate 84 is midway between its opposite end limits of rotative adjustment relative to plate 62, while FIGS. 5*b* and 5*c* show shutter plate 84 respectively at its opposite end limits of rotative adjustment as determined by the engagement of shutter blade 94 with the corresponding end of stop rib 80 as in FIG. 5*b* or the similar engagement of shutter blade 90 with the opposite end of that stop rib as shown in FIG. 5*c*. The other longer blades similarly cooperate the respective sets of stop ribs.

In FIG. 5*a*, shutter plate 84 is so positioned that openings 66 are completely covered by shutter blades 86 and 92, opening 70 is completely covered by shutter blade 94, while one-half of each of openings 68 is covered by blades 94 and 88. With shutter plate 84 in this rotative position, the only openings in flow directing plate 62 which are exposed are openings 68. Hence, all flow through the showerhead occurs through the first flow passage referred to above — namely from openings 68 to trough 46 and then via tangential passages 50 into the interior of spray cup 38 for discharge through orifices 44. As already indicated, water passing through passages 50 impinges on blades 60 to drive valve 54 in rotation and thus cyclically open and close orifices 44. Because all of the water flowing through the unit, when shutter plate 84 is in the position of FIG. 5*a*, must be discharged through orifices 44, all the spray discharged is in pulsating form. Further because of the fact that all of the water then flowing through the showerhead impinges on blades 60, valve 54 is then driven at a maximum rate of rotation for a given amount of supply pressure, and the frequency of the pulsation of the delivered streams is at a maximum.

Rotation of shutter plate 84 is accomplished by annular rotation of control ring 112, gear 110 on control ring 112 driving pinion 108 so as to rotate shaft 104 and pinion 102. Pinion 102 is in mesh with ring gear 85 of shutter plate 84. Upon rotation of shutter plate 84 in a clockwise direction from the position shown in FIG. 5*a* toward the position shown in FIG. 5*b*, the area of openings 68 exposed between shutter blades 88, 90, 94 and 96 remains constant. However, as shutter plate 84 rotates clockwise away from its FIG. 5*a* position, the trailing edge of shutter blade 94 begins to expose opening 70 and an increasing portion of the water flowing through the device passes through opening 70.

Water passing through opening 70 follows the second flow passage described above and is discharged from opening 70 axially into the interior of spray cup 38. The radial location of opening 70 is such that water flowing from that opening passes axially through the rotary path of blades 60, thus exerting a slight braking action on the rate of rotation on the blades. The rate of rotation of the blades is further reduced due to the fact that, as the volume of flow through opening 70 begins to build up when that opening is exposed by rotation of shutter plate 84, a consequent reduction occurs in the volume of flow through openings 68, troughs 48 and tangential passages 50. This reduces the volume and rate of flow of water discharged through passages 50 from which the driving force causing the rotation of valve rotor 54 is derived.

Because openings 66 remain blocked during movement of shutter plate 84 between the FIGS. 5*a* and 5*b* positions, all flow through the unit occurs within the first and second flow passages described above, these flows being united in the interior of spray cup 38 and thus being discharged through orifices 44. Therefore, an all-pulsating flow is achieved throughout the full range of movement of shutter plate 84 between the FIG. 5*a* and FIG. 5*b* positions. However, the frequency of pulsation of this flow varies in accordance with the rotative position of shutter plate 84, the frequency being a minimum when the maximum area of exposure of opening 70 is achieved in the FIG. 5*b* position and the frequency of pulsation increasing as shutter plate 84 is rotated from the FIG. 5*b* position toward the FIG. 5*a* position at which the pulsation frequency reaches a maximum for a given supply pressure.

Upon movement of shutter plate 84 in a counterclockwise direction from the FIG. 5*a* position toward the FIG. 5*c* position, opening 70 remains covered by shutter blade 94, while the counterclockwise movement of shutter blades 86 and 92 begins progressively to expose openings 66 to flow from chamber 120. Furthermore, counterclockwise movement of shutter blades 88 and 94 from the FIG. 5*a* position toward the FIG. 5*c* position progressively reduces the area of openings 68 available to flow from inlet chamber 120 until, upon arrival of shutter plate 84 at the FIG. 5*c* position, openings 68 are completely covered by shutter blades 88 and 94, while shutter blades 86 and 92 have moved to positions where openings 66 are fully open.

When shutter plate 84 is in the FIG. 5*c* position, all flow through the unit occurs by way of the third flow passage previously mentioned. That flow passes from openings 66 through passageways 48 along the exterior of spray cup 38 so as to be discharged from the outer ring of orifices 34. Because the flow to orifices 34 completely bypasses rotary valve 54, all water discharged from orifices 34 is delivered in the conventional continuous stream. Thus, when shutter plate 84 is in the FIG. 5*c* position, an all-continuous spray is discharged by the device.

When shutter plate 84 is at some position intermediate the FIG. 5*a* and 5*c* positions, both openings 68 and openings 66 are partially opened so that flow through the device is apportioned between those two sets of openings in accordance with the rotative position of shutter plate 84. At these intermediate positions, the spray discharge consists of a continuous spray component constituted by that portion of the flow which passes through openings 66 and a pulsating spray portion constituted by the remaining portion of the flow which passes through openings 68. Over this range of movement of shutter plate 84, the frequency of pulsation of the pulsating portion of the spray will likewise vary in proportion to that component of the flow which passes through orifices 44. Starting from an all-continuous flow with shutter plate 84 in the FIG. 5*c* position, rotation of shutter plate 84 toward the FIG. 5*a* position produces a gradually increasing component of pulsating flow that has a progressively increasing frequency as the FIG. 5*a* position is approached.

To summarize the flow characteristics of the unit, starting with shutter plate 84 at the FIG. 5*c* position and assuming a constant supply pressure within inlet chamber 120, all flow emitted from the unit is discharged from orifices 34 in continuous uninterrupted or non-pulsating streams. As the control ring is rotated to drive the shutter plate in a clockwise direction away from the FIG. 5*c* position, the percentage of the flow discharged from orifices 34 is progressively reduced, while a correspondingly increasing percentage of the flow is discharged from orifices 44. Spray discharged from orifices 44 is a pulsating spray and, as the percentage of flow through orifices 44 builds up, the frequency of pulsation increases until shutter plate 84 reaches the FIG. 5*a* position at which time the percentage of spray discharged from orifices 34 has been decreased to zero. Continued rotation of control ring 112 to drive shutter plate 184 in a clockwise direction beyond the FIG. 5*a* position causes the device to discharge an all-pulsating spray but decreases the frequency of the pulsation as shutter plate 84 moves toward the FIG. 5*b* position. The frequency of pulsation may also be varied by varying the supply pressure by adjustment of any control faucets which may be included in the supply system.

A very large part of what has just been described is in common with the aforementioned U.S. Pat. No. 3,801,019. That is, at the outset, because the apparatus disclosed by and claimed in that patent operates entirely in accordance with the same principles as those of the apparatus herein disclosed. Accordingly, attention is again directed to the features which characterize the improvements additionally enclosed herein. These include the now much-desired form of washer 36 which precludes the emission of undesired spray irregularities. The additional seals in passages 66, between flow director plate 62 and spray cup 38, as well as the additional features that permit sure captivation of those seals, are of substantial utility. Other important features newly disclosed include various seal-directing and enforcing ribs and spacings that contribute admirably to the production of an overall unit which is both economical of manufacture and durable in service.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. In a spray nozzle that includes:

a housing having a fluid inlet and a first and a second group of fluid spray discharge outlets;

means in said housing defining a first flow path from said inlet to said first group of outlets and a second flow path from said inlet to said second group of outlets;

pulsation means in said first flow path for cyclically interrupting the flow of fluid from said inlet to said first group of outlets and cause a pulsating spray to be discharged therefrom;

said second flow path bypassing said pulsation means to cause a continuous non-pulsating spray to be discharged from said second group of outlets;

and control means for adjustably dividing flow from said inlet between said first and second flow paths;

the improvement comprising:

a spray cup assembly having a tubular main body across one end of which extends an end wall, said main body having an external diameter less than the internal diameter of the end of said housing opposite said fluid inlet so that said spray cup assembly is received within that end of said housing;

means in said end wall defining said first group of outlets;

means defining an annular groove extending around the lateral exterior of said spray cup assembly and of predetermined width in the direction axially of said spray cup assembly;

means defining a series of slots in the internal wall of said housing at said end thereof, said slots extending in said direction and being distributed around the internal circumference of said wall;

and a seal of resilient material formed into the shape of a washer having an integral cross-section in said direction composed of a pair of legs apart by a connecting web, the length of one of said legs being at least approximately the same as said predetermined width of said groove, said seal being seated between said slots and said groove with said one leg disposed in said groove and the other leg extending across the open radially inner sides of said slots so as, together with said slots, to define said second group of outlets.

2. A spray nozzle as defined in claim 1 in which said other leg of said seal extends over at least substantially the length of said slots.

3. A spray nozzle as defined in claim 1 in which said seal is of U-shaped cross-section.

4. A spray nozzle as defined in claim 3 in which the bite portion of said U-shaped cross-section faces toward the outlet end of said slots.

5. A spray nozzle as defined in claim 1 in which said seal is of N-shaped cross-section.

6. A spray nozzle as defined in claim 5 in which said web extends from the end of said one leg adjacent to the outlet end of said assembly to the end of said other leg adjacent to the inlet of said slots.

7. A spray nozzle as defined in claim 6 in which, when said seal is unseated from said groove and said slots, said other leg flares radially outwardly with increasing distance away from the junction between said web and said other leg.

8. A spray nozzle as defined in claim 5 in which said other leg of said seal extends over at least substantially the length of said slots.

9. In a spray nozzle that includes:

a housing having a fluid inlet and a first and a second group of fluid spray discharge outlets;

means in said housing defining a first flow path from said inlet to said first group of outlets and a second flow path from said inlet to said second group of outlets;

pulsation means in said first flow path for cyclically interrupting the flow of fluid from said inlet to said first group of outlets and cause a pulsating spray to be discharged therefrom;

said second flow path bypassing said pulsation means to cause a continuous non-pulsating spray to be discharged from said second group of outlets;

and control means for adjustably dividing flow from said inlet between said first and said second flow paths;

the improvement comprising:

a flow-directing plate mounted in said housing between said inlet and said outlets and having first and second openings therethrough respectively establishing communication between said inlet and said first and second flow paths, said first and second openings being located near the periphery of said plate and spaced apart around said periphery;

means in one of said openings defining a counterbore extending therein from the inlet side of said plate;

a resilient annular seal element seated in said counterbore;

shutter means slidably mounted on said plate for coordinated movement into and out of overlying flow-blocking relationship with said openings between a first position wherein said second opening is blocked and flow from said inlet is directed through said first opening and a second position wherein said first opening is blocked and flow from said inlet passes through said second opening, movement of said shutter means between said positions progressively changing the amount of flow respectively delivered through each of said openings;

said shutter means including an annular ring from which project radially inward a plurality of shutter blades respectively spaced individually around the periphery of said ring, movement of said shutter means between said positions alternately covering and uncovering respective one of said openings with corresponding ones of said blades and with the one of said blades covering said one of said openings effectively captivating said resilient annular seal in sealing relationship with said counterbore.

10. A spray nozzle as defined in claim 9 in which a web member, spaced inwardly from said periphery of said ring, projects at least substantially across the space defined between successive ones of said blades in a position maintaining captivation of said resilient annular seal when said shutter means is moved to remove the corresponding one of said blades from covering relationship to said one of said openings.

11. A spray nozzle as defined in claim 10 in which said web member projects integrally from one side of one of said blades and extends into close-spaced relationship with the successive ones of said blades.

12. A spray nozzle as defined in claim 9 which further includes a plurality of each of said first and second openings alternately and symmetrically spaced around said periphery of said plate together with a correspondingly increased plurality of said shutter blades spaced around said periphery of said ring, and which still further includes a plurality of stop ribs each projecting from said plate substantially through said shutter means toward said inlet and individually spaced radially inward from alternate ones of said blades in the path of corresponding intervening ones of said blades.

13. In a spray nozzle that includes:

a housing having a fluid inlet and a first and a second group of fluid spray discharge outlets;

means of said housing defining a first flow path from said inlet to said first group of outlets and a second flow path from said inlet to said second group of outlets;

pulsation means in said first flow path for cyclically interrupting the flow of fluid from said inlet to said first group of outlets and cause a pulsating spray to be discharged therefrom;

said second flow path bypassing said pulsation means to cause a continuous non-pulsating spray to be discharged from said second group of outlets;

and control means for adjustably dividing flow from said inlet between said first and said second flow paths;

the improvement comprising:

a flow-directing plate mounted in said housing between said inlet and said outlets and having first and second openings therethrough respectively establishing communication between said inlet and said first and second flow paths, said first and second openings being located near the periphery of said plate and spaced apart around said periphery;

shutter means slidably mounted on said plate for coordinated movement into and out of overlying flow-blocking relationship with said openings between a first position wherein said second opening is blocked and flow from said inlet is directed through said first opening and a second position wherein said first opening is blocked and flow from said inlet passes through said second opening, movement of said shutter means between said positions progressively changing the amount of flow respectively delivered through each of said openings;

a generally tubular body constituting a portion of said housing and containing said pulsation means;

means defining first and second flow passages extending axially through said body and respectively constituting respective portions of individual different ones of said flow paths, said flow passages being adjacent to and spaced successively around the periphery of said body in communication with the respective ones of said first and second openings in said plate;

means defining an end wall of said body through which said second flow path extends;

means in said housing defining a mating wall through which said second flow path extends;

an annular washer sandwiched between said end wall and said mating wall and having means defining apertures through which said first and second flow paths respectively extend;

and a rib outwardly projecting from one of said walls into sealing engagement with said washer, said rib extending continuously around the general perimeter of said one wall and being disposed radially outward of one of said flow paths and radially inward of the other of said flow paths.

14. A spray nozzle as defined in claim 13 in which said rib is disposed inwardly of said second flow path and outwardly of said first flow path.

15. A spray nozzle as defined in claim 13 in which said mating wall is formed in the side of said flow-directing plate opposite said inlet.

16. A spray nozzle as defined in claim 15 in which said rib projects integrally from said mating wall.

17. A spray nozzle as defined in claim 13 in which said mating wall is formed in the portion of said housing in which said first group of outlets is contained.

18. A spray nozzle as defined in claim 17 in which said rib projects integrally from said tubular body.

19. In a spray nozzle that includes:

a housing having a fluid inlet and a first and a second group of fluid spray discharge outlets;

means in said housing defining a first flow path from said inlet to said first group of outlets and a second flow path from said inlet to said second group of outlets;

pulsation means in said first flow for cyclically interrupting the flow of fluid from said inlet to said first group of outlets and cause a pulsating spray to be discharged therefrom;

said second flow path bypassing said pulsating means to cause a continuous non-pulsating spray to be discharged from said second group of outlets;

and control means for adjustably dividing flow from said inlet between said first and said second flow paths;

the improvement comprising:

a flow-directing plate mounted in said housing between said inlet and said outlets and having first and second openings therethrough respectively establishing communication between said inlet and said first and second flow paths, said first and second openings being located near the periphery of said plate and spaced apart around said periphery;

shuter means slidably mounted on said plate for coordinated movement into and out of overlying flow-blocking relationship with said openings between a first position wherein said second opening is blocked and flow from said inlet is directed through said first opening and a second position wherein said first opening is blocked and flow from said inlet passes through said second opening, movement of said shutter means between said positions progressively changing the amount of flow respectively delivered through each of said openings;

an end cap portion of said housing including said fluid inlet;

means projecting through said end cap portion for enabling said movement of said shutter means;

a tab projecting from said flow-directing plate into engagement with said end cap portion for seating said plate in position within said housing;

a washer disposed around the perimeter of said end cap in sealing engagement with the perimeter of said shutter means;

and an annular retainer member disposed adjacent to said end cap member and immediately within said washer radially, said member including means defining an opening accommodating said projecting means and another opening through which the end of said tab projects into contact with said end cap portion.

20. A spray nozzle as defined in claim 19 in which said retainer member is a separate part and further includes a plurality of outwardly projecting rib portions frictionally engageable with said end cap portion.

21. In a spray nozzle that includes:

a housing having a fluid inlet and a first and second group of fluid spray discharge outlets;

means in said housing defining a first flow path from said inlet to said first group of outlets and a second flow path from said inlet to said second group of outlets;

pulsation means in said first flow path for cyclically interrupting the flow of fluid from said inlet to said first group of outlets and cause a pulsating spray to be discharged therefrom;

said second flow path bypassing said pulsation means to cause a continuous non-pulsating spray to be discharged from said second group of outlets;

control means for adjustably dividing flow from said inlet between said first and second flow paths;

the improvement comprising:

a spray cup assembly having a tubular main body across one end of which extends an end wall, said main body having an internal diameter less than the internal diameter of the end of said housing opposite said fluid inlet so that said spray cup assembly is received within that end of said housing;

means in said end wall defining said first group of outlets;

means defining an annular groove extending around the lateral exterior of said spray cup assembly and of predetermined width in the direction axially of said spray cup assembly;

means defining a series of slots in the internal wall of aid housing at said end thereof, said slots extending in said direction and being distributed around the internal circumference of said wall;

a seal of resilient material formed into the shape of a washer having an integral cross-section in said direction composed of a pair of legs spaced apart by a connecting web, the length of one of said legs being at least approximately the same as said predetermined width of said groove, said seal being seated between said slots and said groove with said one leg disposed in said groove and the other leg extending across the open radially inner sides of said slots so as, together with said slots, to define said second group of outlets;

a flow-directing plate mounted in said housing between said inlet and said outlet and having first and second openings therethrough respectively establishing communication between said inlet and said first and second flow paths, said first and second openings being located near the periphery of said plate and spaced apart around said periphery;

means in one of said openings defining a counterbore extending therein from the inlet side of said plate;

a resilient annular seal element seated in said counterbore;

shutter means slidably mounted on said plate for coordinated movement into and out of overlying flow-blocking relationship with said openings between a first position wherein said second opening is blocked and flow from said inlet is directed through said first opening and a second position wherein said first opening is blocked and flow from said inlet passes through said second opening, movement of said shutter means between said positions progressively changing the amount of flow respectively delivered through each of said openings;

said shutter means including an annular ring from which project radially inward a plurality of shutter blades respectively spaced individually around the periphery of said ring, movement of said shutter means between said positions alternately covering and uncovering respective ones of said openings with corresponding ones of said blades and with one of said blades covering said one of said openings effectively captivating said resilient annular seal in sealing relationship with said counterbore;

a generally tubular body constituting a portion of said housing and containing said pulsation means;

means defining first and second flow passages extending axially through said body and respectively constituting respective portions of individual different ones of said flow paths, said flow passages being adjacent to and spaced successively around the periphery of said body in communication with respective ones of said first and second openings in said plate;

means defining an end wall of said body through which said second flow path extends;

means in said housing defining a mating wall through which said second flow path extends;

an annular washer sandwiched between said end wall and said mating wall and having means defining apertures through which said first and second flow paths respectively extend;

a rib outwardly projecting from one of said walls into sealing engagement with said washer, said rib extending continuously around the general perimeter of said one wall and being disposed radially outward of one of said flow paths and radially inward of the other of said flow paths;

an end cap portion of said housing including said fluid inlet;

means projecting through said end cap portion for enabling said movement of said shutter means;

a tab projecting from said flow-directing plate into engagement with said end cap portion for seating said plate in position within said housing;

a washer disposed around the perimeter of said end cap in sealing engagement with the perimeter of said shutter means;

and an annular retainer member disposed adjacent to said end cap and immediately within said washer radially, said member including means defining an opening accommodating said projecting means and another opening through which the end of said tab projects into contact with said end cap portion.

* * * * *